United States Patent [19]

Schröter

[11] Patent Number: 4,523,675

[45] Date of Patent: Jun. 18, 1985

[54] COLLAPSIBLE DISPLAY STAND WITH ATTACHED TRAY

[75] Inventor: Stefan Schröter, Neutraubling, Fed. Rep. of Germany

[73] Assignee: Schroter + Bake GmbH & Co., KG, Neutraubling, Fed. Rep. of Germany

[21] Appl. No.: 332,931

[22] Filed: Dec. 21, 1981

[30] Foreign Application Priority Data

Dec. 19, 1980 [DE] Fed. Rep. of Germany ... 8033787[U]
Nov. 26, 1981 [DE] Fed. Rep. of Germany ... 8134499[U]

[51] Int. Cl.[3] ..... B65D 5/52

[52] U.S. Cl. ..... 206/44 R; 229/16 D; 229/23 R; 248/174

[58] Field of Search ..... 229/30, 16 D, 23 R; 206/44 R, 45.19, 45.2, 45.22, 45.25, 45.27; 248/174

[56] References Cited

U.S. PATENT DOCUMENTS

| | | | |
|---|---|---|---|
| Re. 25,309 | 1/1963 | Adams | 248/174 |
| 2,066,844 | 1/1937 | Lyrch | 248/174 |
| 2,326,648 | 8/1943 | Horr | 312/110.2 |
| 2,550,959 | 5/1951 | Bowman | 248/174 X |
| 2,825,519 | 3/1958 | Potts | 248/174 |
| 2,827,162 | 3/1958 | Garman | 206/44 R |
| 2,940,710 | 6/1960 | Adams | 248/174 |
| 3,164,350 | 1/1965 | Taub | 206/44 R |
| 3,237,901 | 3/1966 | Guyer, Jr. et al. | 248/174 |
| 3,300,166 | 1/1967 | Wojciechowski | 248/174 |
| 3,340,998 | 9/1967 | Wilson | 248/174 X |
| 3,464,569 | 9/1969 | Downing | 248/174 X |
| 3,836,104 | 9/1974 | Miller | 248/174 |

FOREIGN PATENT DOCUMENTS

| | | | |
|---|---|---|---|
| 2902573 | 7/1980 | Fed. Rep. of Germany . | |
| 1254983 | 1/1961 | France | 248/174 |
| 1312374 | 4/1973 | United Kingdom | 248/174 |

*Primary Examiner*—William Price
*Assistant Examiner*—Gary E. Elkins
*Attorney, Agent, or Firm*—Sandler & Greenblum

[57] ABSTRACT

A foldable display stand made from cardboard or like material having a support stand and a tray portion fixed to the support stand. In collapsed form, the support stand wraps around the tray. The support stand includes two walls which extend upwardly to a ceiling. The ceiling is made of two panels of equal size and foldable upwardly by a common center fold line. One panel of the ceiling is bonded to the bottom of the tray. When erecting the display stand, the two opposite lateral walls, which include vertical foldable center fold lines, are extended by the weight of the tray to the extent that the two panels of the ceiling are arranged in a common plane.

3 Claims, 4 Drawing Figures

1
2
3
4
5
6
7
8
9
10
11
12
13
14
15
16
16'
17
18
19
20
21

2
3
8,9
12
18

COLLAPSIBLE DISPLAY STAND WITH ATTACHED TRAY

BACKGROUND OF THE INVENTION

1. Field of the Invention

This invention refers generally to floor display stands made from carton, corrugated paper or similar material, comprising a supporting portion of parallelepiped shape and a tray portion supported thereon e.g. a box, container or similar structure; the supporting portion and tray portion are connectd to each other e.g., by bonding. The supporting portion is provided with a vertical inwardly foldable center fold line on each of two opposite side walls; and the supporting portion is foldable around the container in its collapsed condition.

2. Description of Prior Art

Display stands of this type as disclosed in DE-OS No. 29 02 573 provide a fold line at an equal distance between two fold lines, and the longitudinal edges of the supporting portion are provided between the two outer fold lines with material cut-out in diamond shape, the tips of which are situated on the three fold lines. The wall portions provided between the outer fold lines form inwardly folded horizontal flanges. The bottom of the tray is connected to the supporting portion by means of a glue flap provided at the upper restriction of the rear wall of the supporting portion. According to a further embodiment of said DE-OS No. 29 02 573, in addition to the glue flap at the rear wall of the supporting portion, an additional glue flap is provided at the front wall of the supporting portion which bonds the supporting portion to the bottom of the tray. In order to allow the supporting portion to fold around the container it is necessary to separate the part of the wall of the supporting portion joining the front glue flap by means of two cutting lines from the adjacent walls extending to a fold line of this wall, which line extends in transvere direction. In the folded condition, the lateral walls of the supporting portion are folded outwardly so that a rather large space is required to store or transport this article. Erecting a display stand of this type is rather complicated and is to be simplified by means of a rubber string which is arranged around the central fold line of the supporting portion. Because erecting such display stands usually is made with filled trays it is necessary for erecting a stand that one person holds the tray and another person erects the supporting portion. Furthermore, the production of this known type of display stand is rather expensive.

It is an object of this invention to develop display stands of the above type in such a manner that structure and production are as simple as possible, that they can be transported in their folded condition with minimum space requirement, and that their erection in situ also with filled trays can be made by a single person without any problems.

SUMMARY OF THE INVENTION

According to the invention this object is obtained by having two opposite walls of the supporting portion extending upwardly to a ceiling formed as a saddle roof, which are fixed, preferably by bonding. The two sections forming the ceiling are of equal area and are provided with a foldline, which forms the top of the saddle roof and extends parallel to the two other walls. One section of the ceiling is fixed, preferably by bonding, to one section of the bottom of the tray, whereas the other section of the ceiling as well the lateral walls of the supporting portion provided with the vertical folding line are not fixed to the bottom of the tray.

With a display stand according to this invention it is possible for transportion, for storage and other purposes, to fold the entire stand in such a manner that its base area is determined by the base area of the tray and that the outer edges of the supporting portion in the folded position of the stand do not extend beyond the tray. This means that the cross-section of the supporting portion can be chosen so that its area is nearly as large as the bottom surface of the tray. In its folded condition the lateral walls with the vertical fold lines of the supporting portion are foldable inwardly, and the entire supporting portion is foldable around the tray in a manner known per se. In the erected condition the weight of the articles within the tray add to the stability of the stand to a considerable extent, because the entire weight of the tray rests on the upper edges of the support portion or part thereof, and the ceiling of the supporting portion prevents the accordion-like lateral movement of the walls in the folding direction so that the ceiling section, together with the weight of the tray and the articles forms locking means for the position of the lateral walls.

Erecting a display stand according to this invention is extremely simple. The display stand is transported and delivered in the folded condition, and is lifted by lifting the tray, and the folded supporting portion is opened similar to a lid so that the supporting portion moves downwardly. As soon as the lower front edge of the supporting portion contacts the ground, the tray is lowered and, in view of the weight of the tray, the two lateral walls, including the accordion-type fold line, automatically fold apart, because the ceiling changes from the shape of the saddle roof to the shape of a flat roof thus causing the accordion-type folds to be forced to open. In this manner the erection of the display stand is extremely simple and automatic, as the supporting portion is opened by force; furthermore, no additional elements (e.g., the rubber string in the above-noted German patent) are required. Moreover, in view of the fact that the cross-section of the supporting portion can be adapted to the cross-section of the tray, it is possible to store the display stand with minimum space requirement and to guarantee high stability of the display stands.

BRIEF DESCRIPTION OF THE DRAWINGS

In the following, the invention is described in combination with the drawings by several embodiments.

DETAILED DESCRIPTION OF THE DRAWINGS

Figure 1:
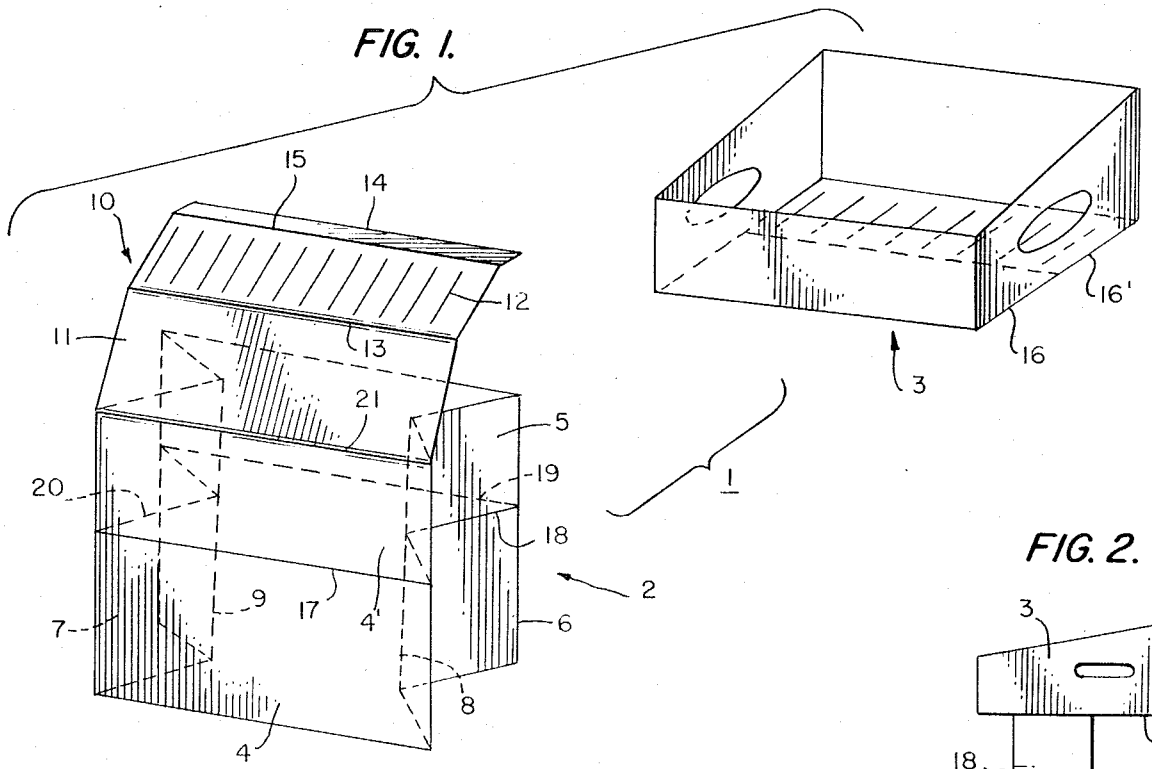
FIG. 1 shows the preferred embodiment of this invention, in which the supporting portion and the tray of the display stand are shown separate from each other in a perspective view.
Figure 2:
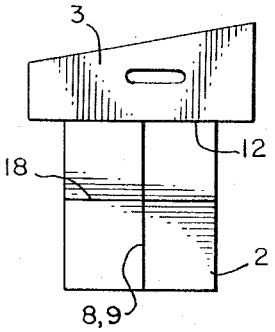
FIG. 2 is a lateral view of the display stand according to FIG. 1 in the erected condition (decreased scale)
Figure 3:
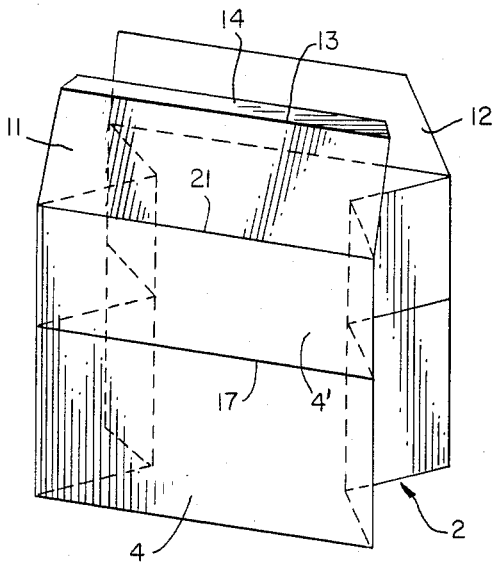
FIG. 3 shows a further embodiment of the supporting portion according to FIG. 1.

The floor display stand 1 according to FIGS. 1, 2 or 3 comprises supporting portion 2 and tray portion 3, which is fixed to the supporting portion or support stand 2 by means of a glue joint. The tray portion can be a container, a tray or the like. As well the supporting portion 2 and the tray portion 3 are preferably made of a one-piece cut of carton, corrugated cardboard or like material, with a glue flap. The supporting portion 2 basically is a diamond-shaped structure with front side 4, 4', rear side 5 and lateral walls 6 and 7. Said lateral walls 6 and 7 each are provided with a vertical folding line 8, 9, by means of which the supporting portion 2 can be folded in such a manner that front wall 4 and rear wall 5 can be moved towards each other, and in the extreme position lay adjacent to each other. Front wall 4 is extended upwardly by an extension or ceiling section 10, which consists of two adjacent sections or panels 11, 12 of identical size, which sections are subdivided by a horizontal folding line 13. The upper edge of the end portion 12 is a glue flap 14, which is bonded to the upper edge of the rear wall 5. Sections 12 and 14 are separated from each other by a folding line 15. The rear portion 16' of the tray bottom 16 is bonded at its lower side to the section 12 so that the supporting portion 2 at the folding line 13 hängs downwardly from tray bottom 16, when tray 3 is lifted. Furthermore, supporting portion 2 is provided with folding line 17, 18, 19, 20, which extends in a horizontal plane and is formed in such a manner that the lower part of the supporting portion 2 in the folded condition of the supporting portion 2 can be folded upwardly around the folding line.

With the embodiment according to FIG. 3 both panel 11 of the front wall 4 with glue flap 14 and panel 12 of the rear wall 5 form the ceiling 10. Panels 11 and 12 which are identical in size are connected to each other by means of glue flap 14. Like the embodiment according to FIG. 1, area 12 in FIG. 3 is that area which is fixed, preferably by bonding to the bottom 16 or the bottom portion 16' of tray 3.

Figure 4:
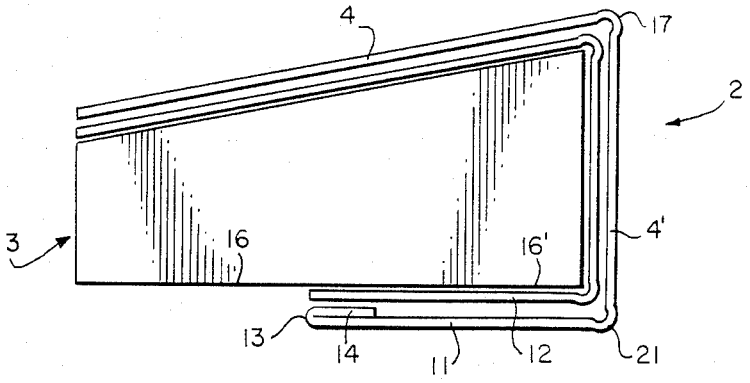
FIG. 4 is a lateral view of the folded display stand according to FIG. 1.

For folding or collapsing, the display stand supporting portion 2 is folded around the folding line 13 so that the lower part of supporting portion 2, as shown in FIG. 4, is folded upwardly around 270° and is taken up by the interior of the tray. Width and length of the collapsed display stand 1 are determined by the dimensions of tray 3, and the supporting portion 2 in the collapsed condition only requires a smaller area than the tray. The shape of the tray can be chosen at will, e.g., it can be a box, possibly with a roof-like cover or lid, however, with extensions formed as a container (horizontal or inclined) with upwardly extending extensions, which allow positioning of the articles to be displayed. Furthermore, the tray can be provided with display elements.

What is claimed is:

1. A display stand comprising a tray and a collapsible support stand adapted to support said tray, said display stand being movable between a first, erect position in which the support stand is substantially vertical and supports said tray and a second, collapsed position in which said support stand is folded about said tray, said tray having a generally rectangular base and a plurality of connected sidewalls extending generally upwardly from said base, said support stand having a front wall, a rear wall, an open top, and two side walls connecting said front and rear walls, each of said side walls having a vertical center fold line which is inwardly foldable, each of said front, rear and side walls of said support stand having a generally horizontal fold line, said support stand further comprising a first ceiling panel integrally hinged by a fold line to said front wall and extending generally upwardly from said front wall when said support stand is in its erect position, and a second ceiling panel which is connected to said first ceiling panel, the base of said tray being bonded to at least one of said ceiling panels, wherein when said display stand is in said second position, said vertical center fold lines are folded inwardly, said ceiling panels are positioned below the base of said tray, and said front and rear walls overlie the open top of said tray.

2. A display stand in accordance with claim 1 wherein said second ceiling panel is integrally connected by a fold line to said first ceiling panel.

3. A display stand in accordance with claim 1 wherein said second ceiling panel is hingedly connected to said rear wall of said support stand by a fold line, and wherein said first and second ceiling panels have free edges which are adhered to each other.

* * * * *